US005803709A

United States Patent [19]

Matthews et al.

[11] Patent Number: 5,803,709

[45] Date of Patent: Sep. 8, 1998

[54] AXIAL FLOW FAN

[75] Inventors: Douglas Matthews; John McBride, both of Brockville; Tim Sutton, Kemptville, all of Canada

[73] Assignee: Canarm Limited, Brockville, Canada

[21] Appl. No.: 568,237

[22] Filed: Dec. 6, 1995

[51] Int. Cl.[6] ..... F04D 29/42

[52] U.S. Cl. ..... 415/182.1; 415/219.1; 415/222

[58] Field of Search ..... 415/182.1, 219.1, 415/222; 454/338

[56] References Cited

U.S. PATENT DOCUMENTS

| | | | |
|---|---|---|---|
| 1,051,852 | 1/1913 | Treat | 415/222 |
| 1,873,343 | 8/1932 | Seyfrird . | |
| 2,027,647 | 1/1936 | Montgomery | 415/222 |
| 2,596,781 | 5/1952 | Moore . | |
| 3,237,489 | 3/1966 | Krell | 415/142 |
| 4,137,709 | 2/1979 | Gongwer | 415/222 |
| 4,153,387 | 5/1979 | Weiler | 415/182.1 |
| 4,221,546 | 9/1980 | Papst et al. | 415/222 |
| 4,225,285 | 9/1980 | Sturm | 415/222 |
| 4,482,302 | 11/1984 | Grignon | 415/222 |
| 4,564,335 | 1/1986 | Harmsen et al. | 415/222 |
| 4,693,669 | 9/1987 | Rogers, Sr. | 415/182.1 |
| 5,040,945 | 8/1991 | Levesque | 415/182.1 |
| 5,096,373 | 3/1992 | Struve et al. | 415/219.1 |

FOREIGN PATENT DOCUMENTS

| | | | |
|---|---|---|---|
| 814297 | 6/1969 | Canada . | |
| 901054 | 5/1972 | Canada . | |
| 963946 | 3/1975 | Canada . | |
| 1034929 | 7/1978 | Canada . | |
| 1093517 | 1/1981 | Canada . | |
| 1132113 | 9/1982 | Canada . | |
| 2204507 | 8/1973 | Germany | 415/209 |
| 60157 | 12/1924 | Sweden | 416/202 |
| 2054040 | 2/1981 | United Kingdom | 415/222 |
| 2 283 534 | 10/1995 | United Kingdom . | |

OTHER PUBLICATIONS

Text Book: Chemical Engineering Magazine, "Fluid Movers", Chemical Engineering McGraw–Hill Pub. Co., 1979 (pp. 93 and 94).

*Primary Examiner*—John T. Kwon
*Attorney, Agent, or Firm*—Bereskin & Parr

[57] ABSTRACT

An axial flow fan primarily for use in harsh and/or corrosive environments such as agricultural barns has a one-piece plastic moulded housing which defines an air flow passageway, and a direct drive fan assembly supported in the air flow passageway by a novel motor mount. The mount includes at least three radially disposed support arms of equal length which maintain the fan assembly in the center of the air flow opening despite distortions in the housing that might occur for example due to temperature changes. Each support arm is a thin and flat plate disposed edge on to the air flow so as to minimize resistance. The air flow opening is smoothly contoured to define a convergent conical inlet section and a divergent conical outlet section for improved efficiency of air flow.

9 Claims, 9 Drawing Sheets

AXIAL FLOW FAN

FIELD OF THE INVENTION

This invention relates generally to axial flow fans primarily, but not exclusively, for use in agricultural environments such as barns, greenhouses and the like.

BACKGROUND OF THE INVENTION

Agricultural environments often are quite "hostile" to mechanical devices such as fans. A fan intended for use in such an environment therefore should be of relatively robust construction and able to resist occasional accidental impacts. Corrosion is a particular problem due to the presence of moisture, animal waste, chemicals and the like. Wide temperature variations often must also be accommodated.

Conventional fans for agricultural use typically are of the so-called box-fan type, comprising a housing which has a square outside shape and a generally cylindrical opening or "tunnel" at the center through which air is blown by a motor-driven fan blade assembly. The housing may be constructed of galvanized sheet steel or wood chip-board. The construction techniques used tend to mean that the housing does not have a smooth external configuration; rather, the structure of the housing often presents large open corners or other crevices in which debris and dust collects quickly in use. As a result of these factors, the housing of a conventional box fan tends to be susceptible to rotting and/or corrosion, which leads to high maintenance costs.

In addition, energy efficiency is a concern. Thus, while a ventilating fan in a barn might be perceived as a relatively unsophisticated device that is not a major factor in terms of energy consumption, a single barn may require a large number of individual fans, each of which may operate continuously. As such, the fans collectively represent a significant energy drain.

Little attention usually is paid to energy efficiency in the design of such fans. For example, the fan blade assembly typically is driven directly by an electric motor which has to be supported in the air flow opening through the housing. Usually, this is accomplished by means of a pair of motor mounting bars that extend vertically across the opening in spaced parallel positions, one on either side of the motor. These bars present a relatively large surface area to the air flowing through the opening. As such, the bars not only block part of the opening, but also create turbulence in the air flowing through the opening—further impeding efficiency of air flow.

Further, since the motor mounting bars extend generally vertically across the opening, the motor mount cannot accommodate distortions in the shape of the air flow opening caused by expansion and contraction of the housing due to temperature changes. As a result, the fan blades may come into contact with the housing in some situations.

Newer, more expensive designs for wall exhaust applications are metal, moulded plastic or fibreglass and improve somewhat on maintenance and performance, but tend to be relatively large and obtrusive. In a barn, for example, the fans represent an impediment to traffic along the outside of the barn walls. Provision is sometimes made for so-called "add on" performance enhancing exhaust cones which are designed to modify and smooth the air flow of the exhaust, but which add to cost and obtrusiveness.

An object of the present invention is to provide a number of improvements in fans which are designed at least partly to address the problems of the prior art.

SUMMARY OF THE INVENTION

According to a first aspect of the invention, there is provided a fan which has a housing defining an air flow opening extending about an axis, a fan blade assembly supported in the housing for rotation about said axis, and a motor carried by the housing and coupled to the fan blade assembly for rotating the assembly about said axis. The air flow opening has a generally cylindrical shape defined by an inlet section, an outlet section, and a throat between the sections. The inlet section has a conically tapered shape which converges smoothly in a direction towards the throat and the outlet section has a conically tapered shape which diverges smoothly in a direction away from the throat. The inlet and outlet sections merge smoothly with the throat so that turbulence in the air flow through the opening is minimized.

Accordingly, in contrast to prior art designs in which little attention is paid to management of the air flow through the fan housing, the invention provides specially profiled air flow opening, which is designed to promote smooth and turbulence-free air passage through the fan housing, without the need for add-on performance enhancing cones.

The throat may be defined by a short cylindrical section between the inlet and outlet sections, or simply by the intersection of the inlet section and the outlet section.

The invention also provides an improved motor support means designed to minimize both obstruction of the air flow through the housing and turbulence in that air.

Accordingly, a further aspect of the invention provides a fan which includes a housing defining an air flow opening extending about an axis, a fan blade assembly, a motor directly coupled to the fan blade assembly coaxially therewith for rotating said assembly and means for supporting the motor in the housing so that the blade assembly rotates about the said axis in use. The motor supporting means comprises at least three support arms which are of substantially equal length and spaced substantially equi-angularly about the said axis, extending generally radially between the motor and the housing. Each arm has a substantially uniform, relatively thin and flat cross-sectional shape so that the arm has a major dimension and a minor dimension. Each arm is disposed with its major dimension in line with the axis of the air flow opening and its minor dimension facing the air flow. Each arm is coupled to each of the housing and the motor respectively at points spaced along the major dimension of the arm so as to resist misalignment of the motor with respect to the axis of the air flow opening.

It will be understood that this form of motor mount presents a number of advantages as compared with the prior art. As noted previously, by positioning the motor mount arms "edge on" to the air flow, both obstruction of the air flow and turbulence are minimized. In fact, the arms may act as flow "straighteners" actually enhancing turbulence-free flow.

Further, by providing at least three radial support arms which are spaced substantially equi-angularly about the axis of the air flow opening, the motor mount is essentially self-centering. In other words, the motor remains centered in the air flow opening despite any distortions of the housing that might arise, for example, due to temperature changes. This minimizes the risk of impact between the fan blades and the housing when distortions do occur. Also as indicated previously, twisting of the motor in the air flow opening is resisted by the way in which the arms are attached to the housing and motor.

A still further aspect of the invention provides a fan which includes a housing defining an air flow opening extending about an axis, a fan blade assembly, means supporting the fan blade assembly in the housing for rotation about the said axis, and a motor carried by the housing and coupled to the fan blade assembly for rotating the assembly about said axis. The housing is a moulded unit having an inner surface defining the said air flow opening, an outer perimeter surface, and front and rear surfaces extending between the inner surface and the outer surface. Preferably, the housing is moulded in one piece, for example by a conventional rotational moulding technique. Examples of suitable materials are plastics such as polyethylene, and fibre-reinforced resins, e.g. fibreglass. In any event, the housing is designed to present a relatively smooth and "crevice-free" exterior surface so that the housing tends to remain relatively clean and free of debris in use and does not provide pockets in which chemicals or other contaminants can accumulate. Selection of the particular material is of course important in providing corrosion resistance to the housing.

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENTS

Figure 1:
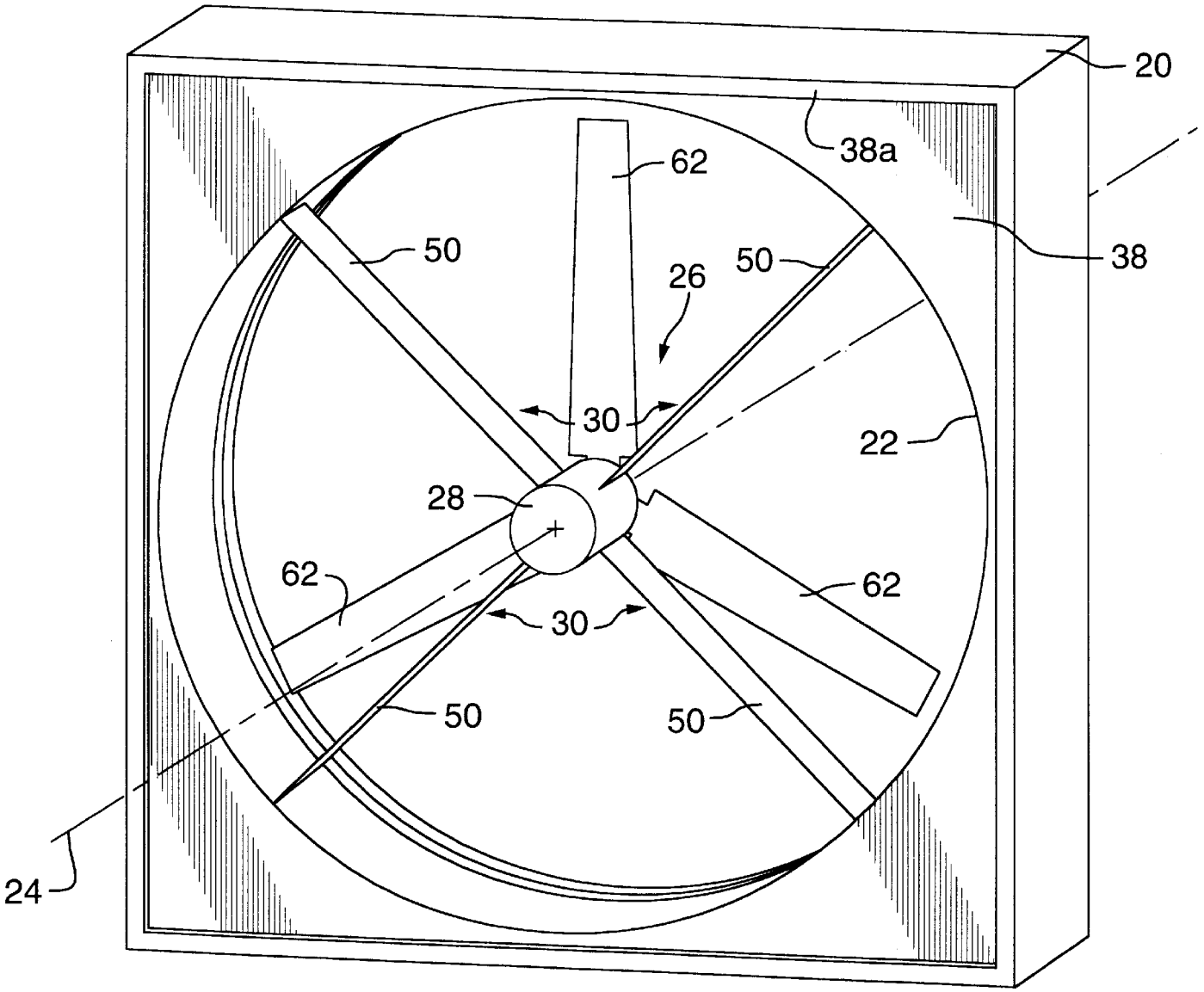
FIG. 1 is a rear perspective view of a fan in accordance with a preferred embodiment of the invention.
Figure 2:
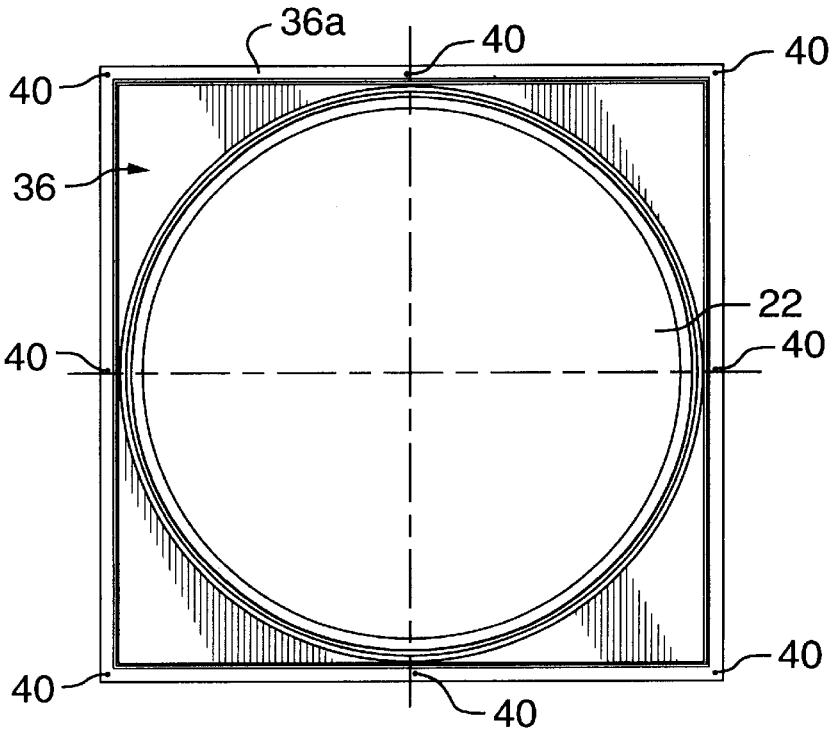
FIGS. 2 and 3 are front and rear elevational views respectively of the housing of the far shown in FIG. 1.
Figure 3:
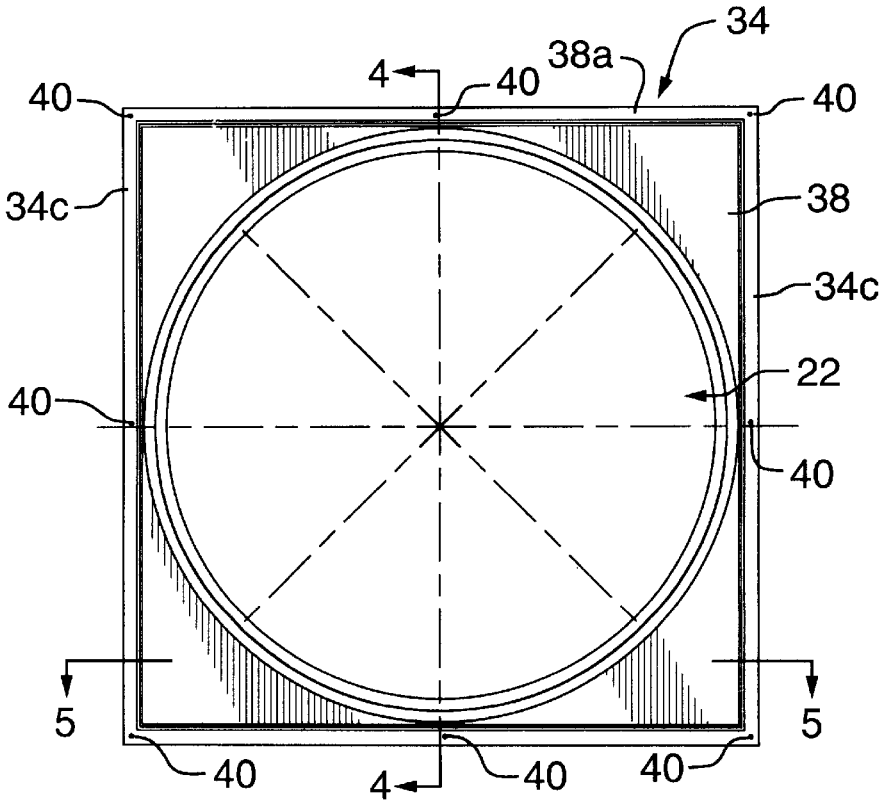
Figure 4:
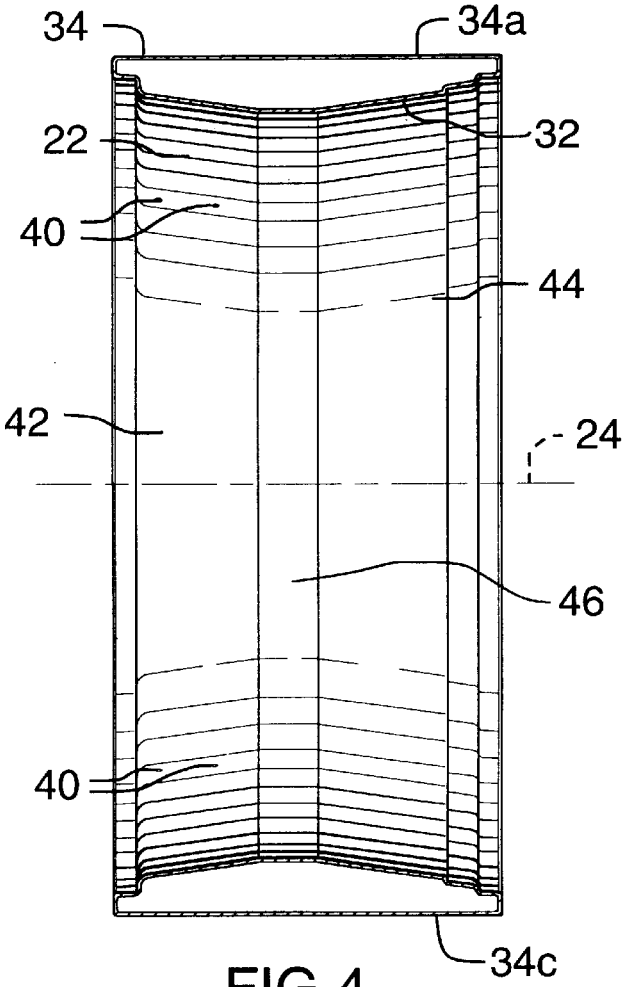
FIGS. 4 and 5 are sectional views taken respectively on lines 4—4 and 5—5 of FIG. 3.
Figure 5:
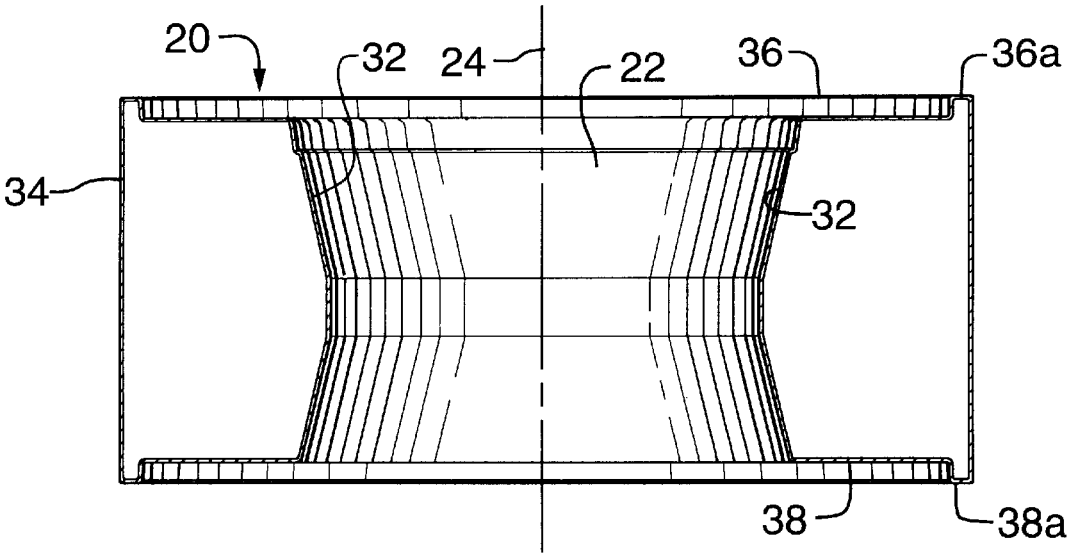

Referring first to FIG. 1, a fan is shown to include a housing 20 which defines an air flow opening 22 extending about an axis 24. A fan blade assembly 26 is supported in the housing for rotation about axis 24 and is driven by a motor 28. Motor 28 is supported in the housing by motor support means generally indicated at 30. In this embodiment, the motor is directly coupled to the fan blade assembly 26, and is supported on axis 24. This will be the usual arrangement although it is to be understood that the invention is not limited thereto. In an alternative embodiment, the motor could be mounted elsewhere on the housing and coupled to the fan assembly by a belt and pulley arrangement or other drive means.

FIGS. 2 to 5 show the fan housing 20 in some detail. In this embodiment, the housing is a one-piece plastic moulding made by a conventional rotational moulding technique. The moulded unit has an inner surface 32 (FIGS. 4 and 5) which defines the opening 22 through the housing, an outer perimeter surface 34 and front and rear surfaces 36 and 38 respectively extending between the inner surface 22 and the outer surface 34. In the embodiment shown, the outer surface 34 has a square shape in profile defined by flat rectangular top and bottom surface portions 34*a* and 34*b* and end surface portions 34*c* and 34*d*.

The inner surface 32 is specially profiled to appropriately manage the air flow through opening 22 as will be described in more detail later, primarily with reference to FIG. 6.

Each of the front and rear surfaces 36 and 38 is shaped to define a marginal rib 36*a*, 38*a* around the perimeter of the surface, which has some strengthening effect. The rib also provides a traditional visual appearance at the front and rear surfaces of the fan housing and may be used for securing the fan in a wall opening. A so-called "stop flange" may be moulded around the inside edge of the outer perimeter surface of the housing as indicated in ghost outline at 39 in FIG. 8.

Moulded into the plastic material during the moulding process are a number of "captive" nuts which can be used to attach external components to the housing. At the front and rear surfaces of the housing, these nuts are moulded into the two peripheral ribs 36*a* and 38*a*. Their locations are indicated by reference numeral 40 in each of FIGS. 2 and 3, from which it will be seen that nuts are provided in each of the corners of each of the front and rear faces, and at locations intermediate the corners. Further nuts are moulded into the inner surface 32 defining the air flow passageway 22, as also indicated by reference numeral 40. The nuts themselves are not shown but similar nuts are indicated at 40*a* in FIG. 6. These nuts provide attachment points for motor mount arms of the motor support means 30, to be described in more detail later.

Figure 6:
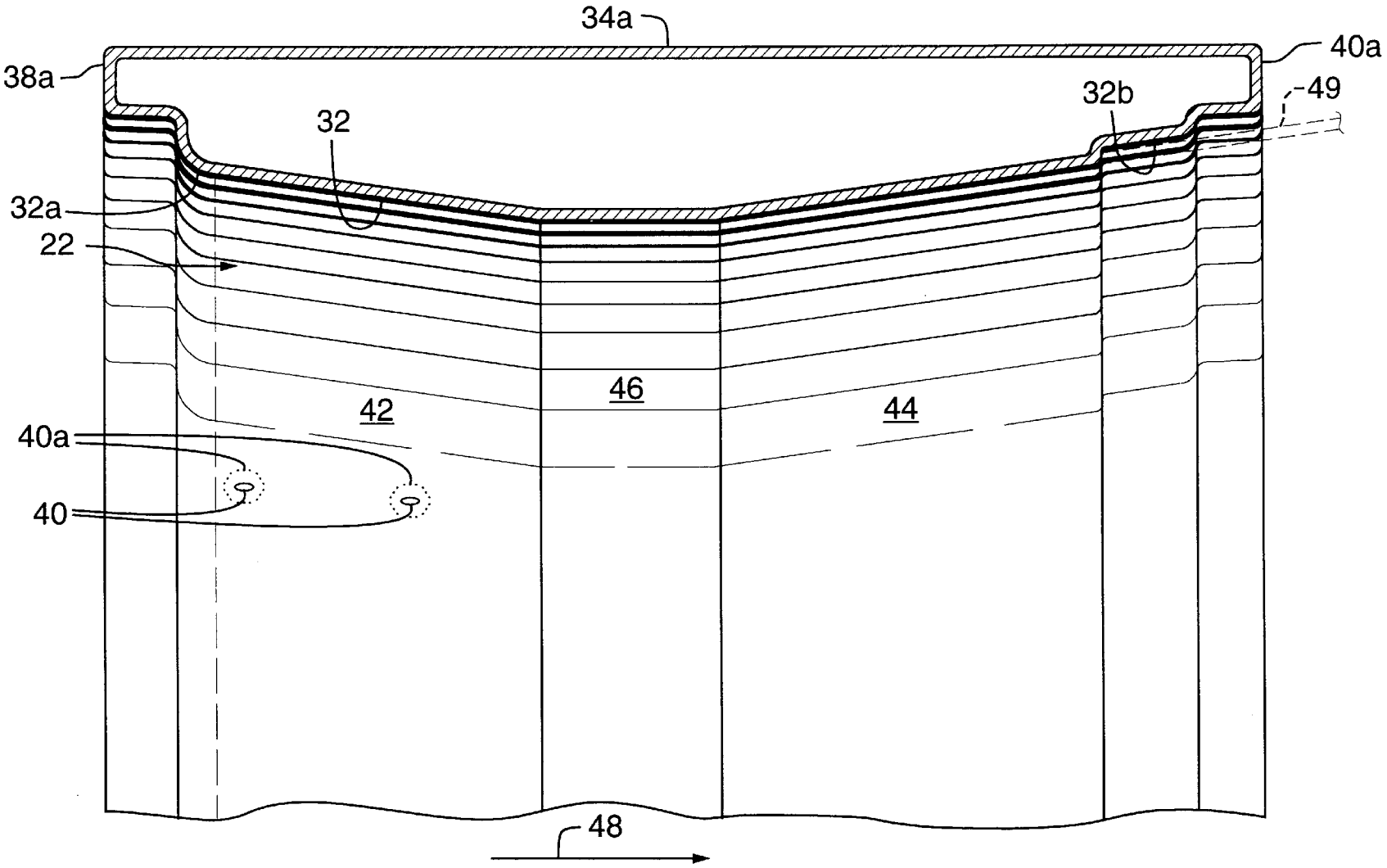
FIG. 6 is an enlarged detail view of the top part of FIG. 4.

FIG. 6, shows in some detail the profile of the inner surface 32 of the moulding, which defines the air flow opening 22. FIG. 6 also shows the hollow, double wall structure that is achieved using the rotational moulding technique. It should be noted that the housing could be solid or foam-filled instead of hollow. The locations of two of the mounting nuts are indicated at 40 in FIG. 6; the nuts themselves are not of course visible since they are embedded within the plastic material, but they are indicated at 40*a*.

It will be seen from FIG. 6, in conjunction with the preceding views, that the air flow opening 22 has a generally cylindrical shape defined by an inlet section 42, an outlet section 44 and a short cylindrical throat 46 between the two sections.

As noted previously, it is not necessary that the throat have any significant axial length. The direction of air flow through the opening is indicated by arrow 48 in FIG. 6. Inlet section 42 has a conically tapered shape which converges smoothly in a direction towards the throat 46 (in the direction of air flow) and the outlet section 44 has a conically tapered shaped which diverges smoothly in a direction away from the throat 46 (also in the direction of air flow). The inlet and outlet sections merge smoothly with the throat so that turbulence in the air flow through the opening is minimized.

By way of example (i.e. without limiting the scope of the invention), the inlet section 42 and the outlet section 44 may each define a cone angle of approximately 8°.

Upstream of inlet section 42, surface 32 is smoothly rounded at 32*a* adjacent the rear peripheral rib 38*a*, avoiding any sharp corners that might induce turbulence in the air flow. The corresponding surface at the outer end of the outlet section 44 is stepped adjacent rib 40*a* to provide a surface 32*b* which is conically tapered so that an optional outlet end extension cone (shown in ghost outline at 49) can be fitted to the housing should this be desired by the user of the fan and secured by screws (not shown). The thickness of the cone will be selected to correspond with the thickness of the inner surface 32 and the depth of the step so that a smooth and effectively uninterrupted surface will be presented to the air flow when a cone is used.

Figure 8:
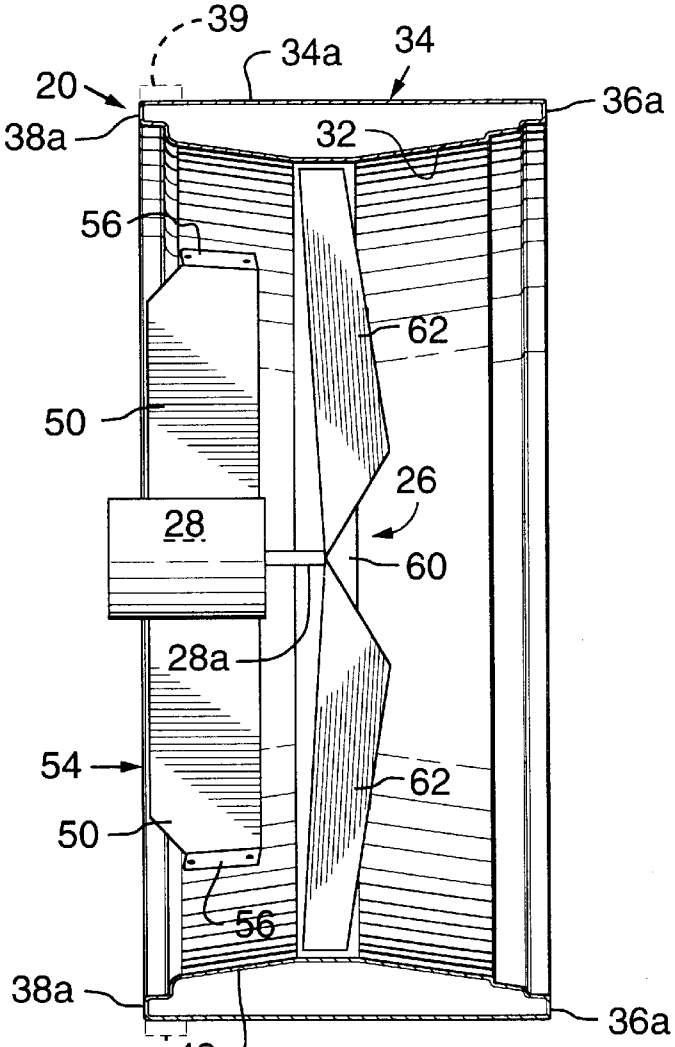
FIG. 8 is a sectional view on line 8—8 of FIG. 7.
Figure 7:
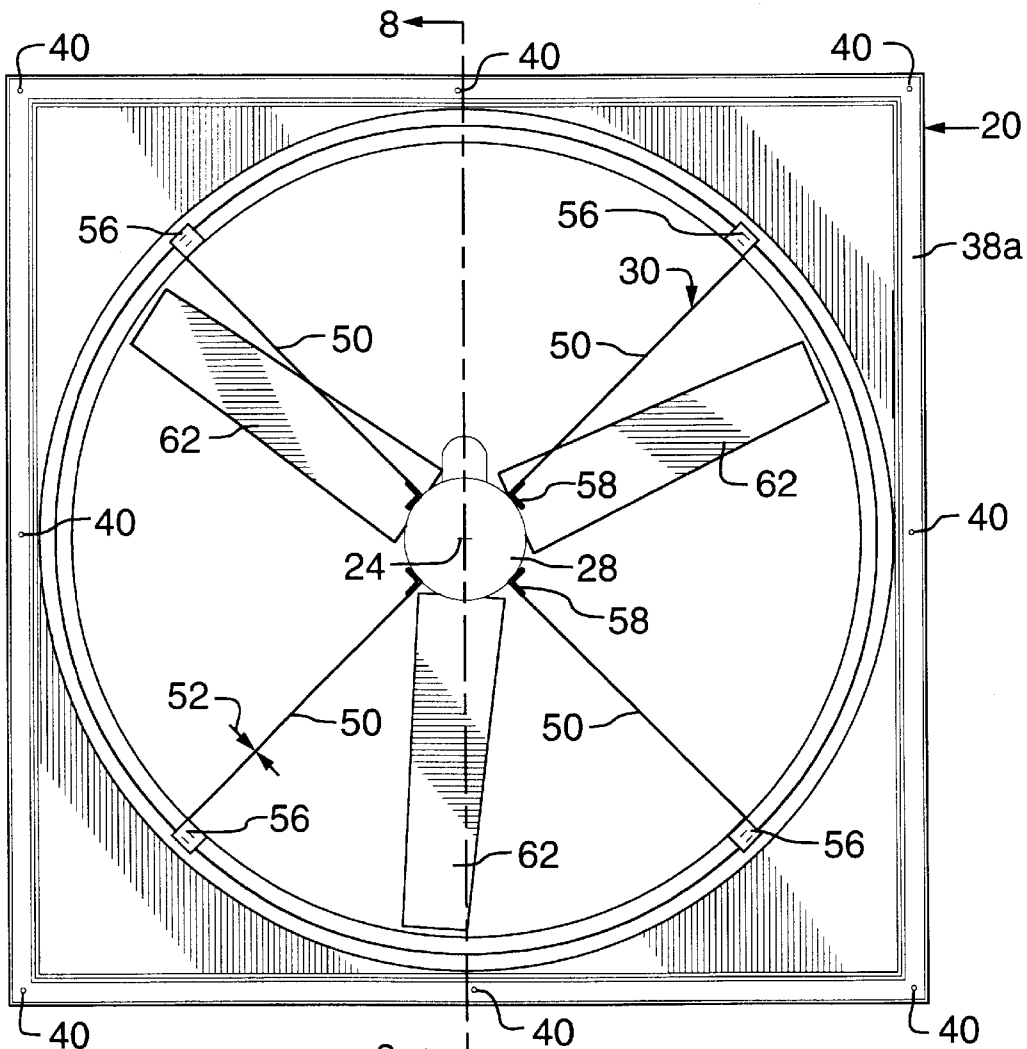
FIG. 7 is a rear elevational view of the complete fan.
Figure 9A:
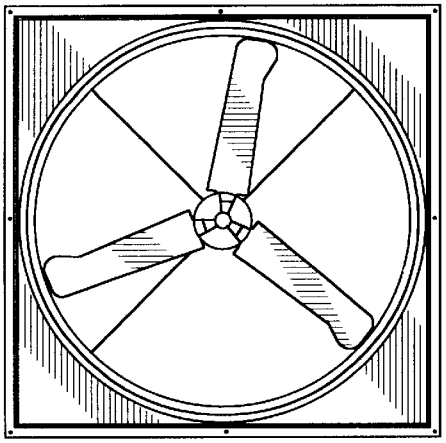
FIG. 9 comprises views denoted (a) to (k) illustrating examples of different types of fan installations that may be achieved by using a fan in accordance with the present invention.
Figure 9B:
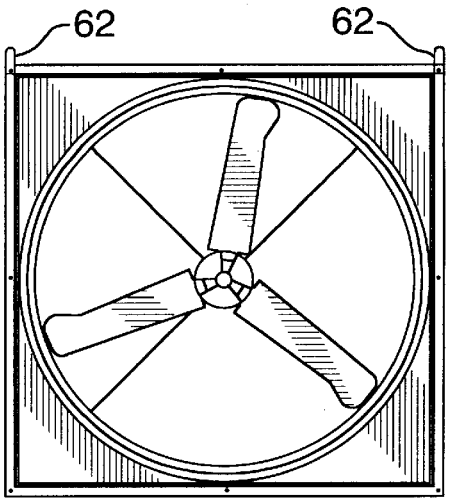
Figure 9C:
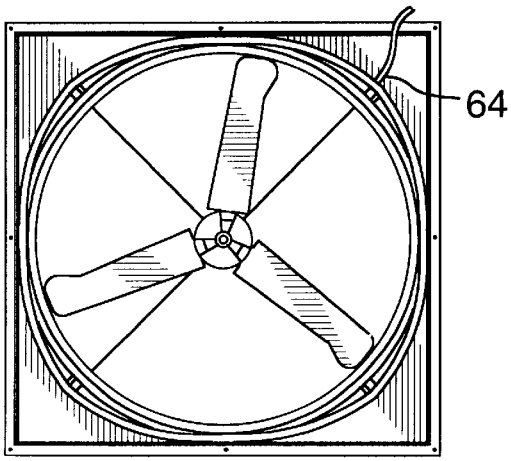
Figure 9D:
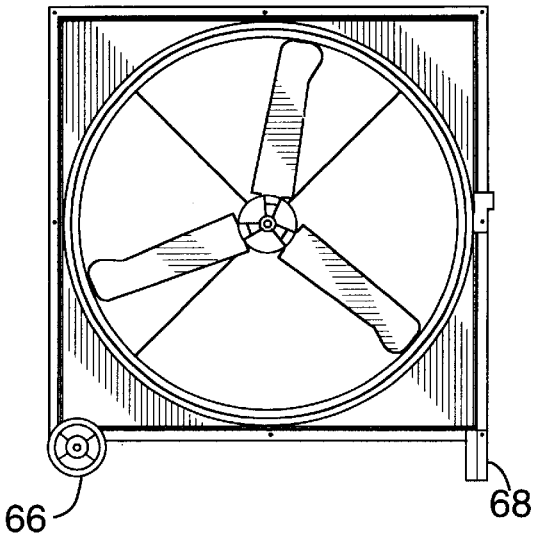
Figure 9E:
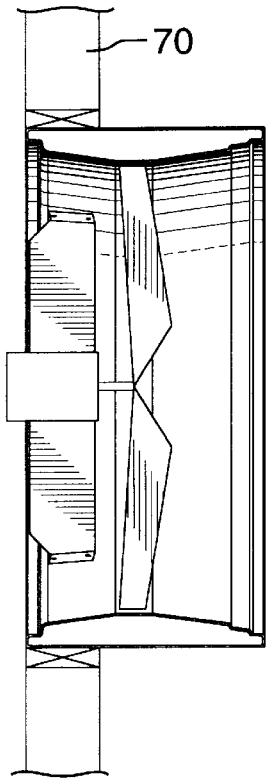
Figure 9F:
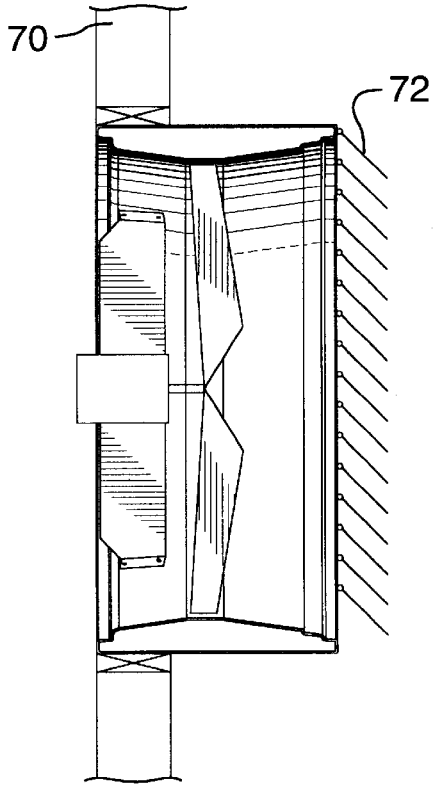
Figure 9G:
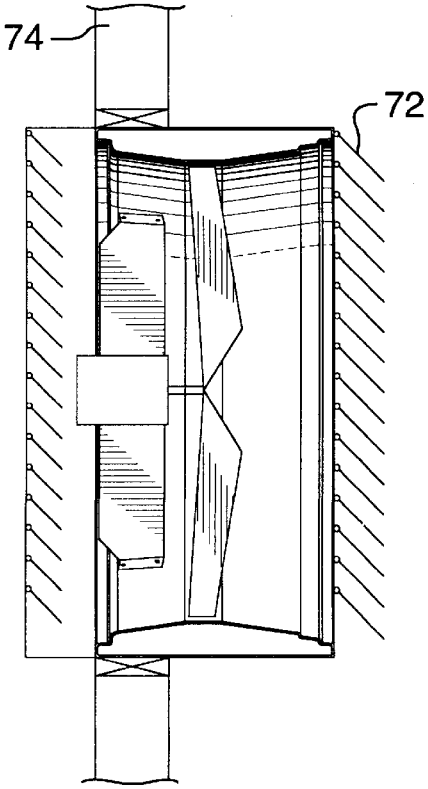
Figure 9H:
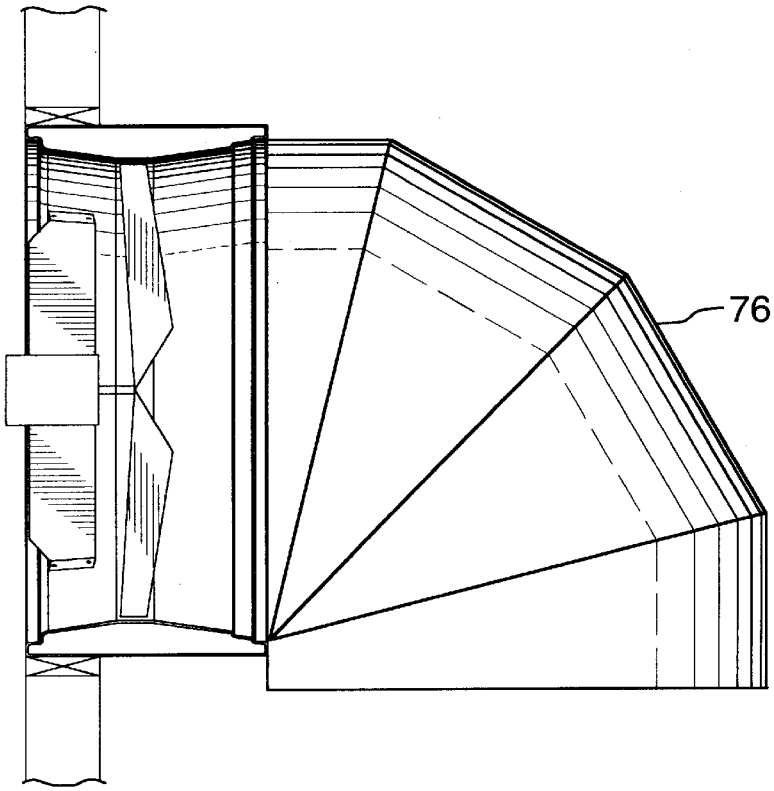
Figure 9I:
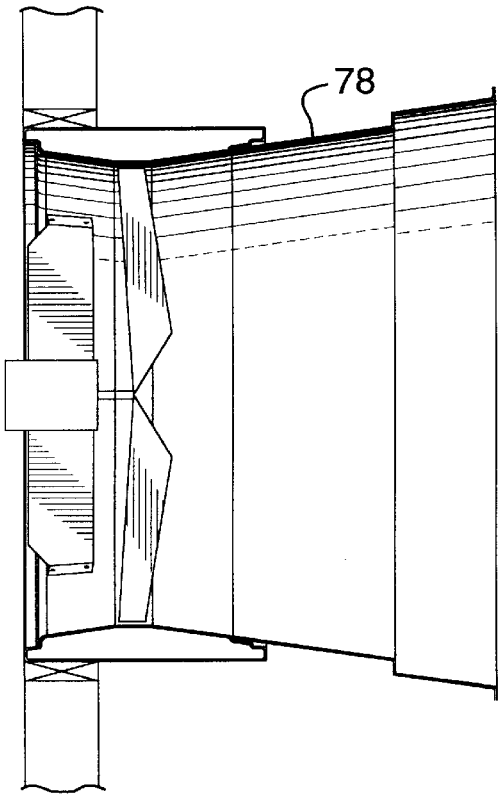
Figure 9J:
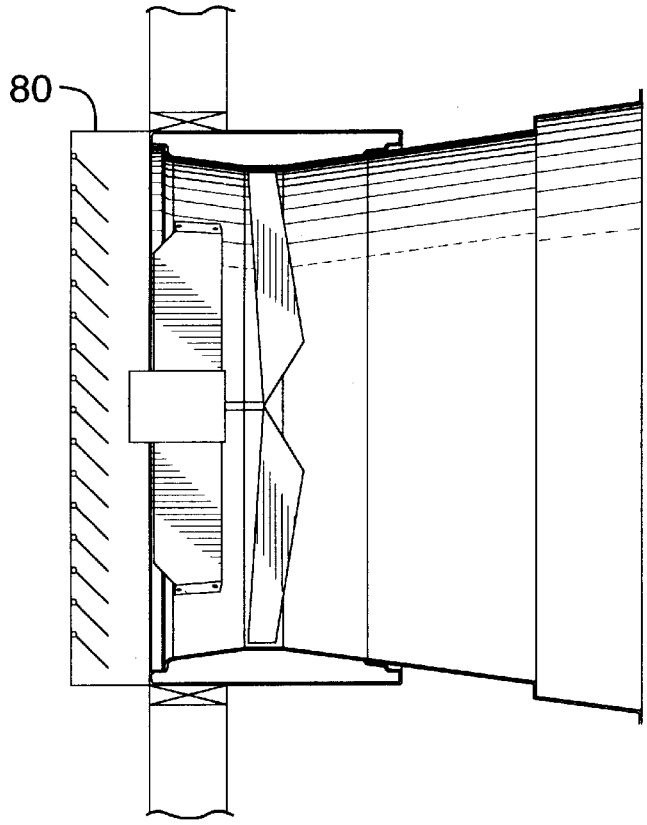
Figure 9K:
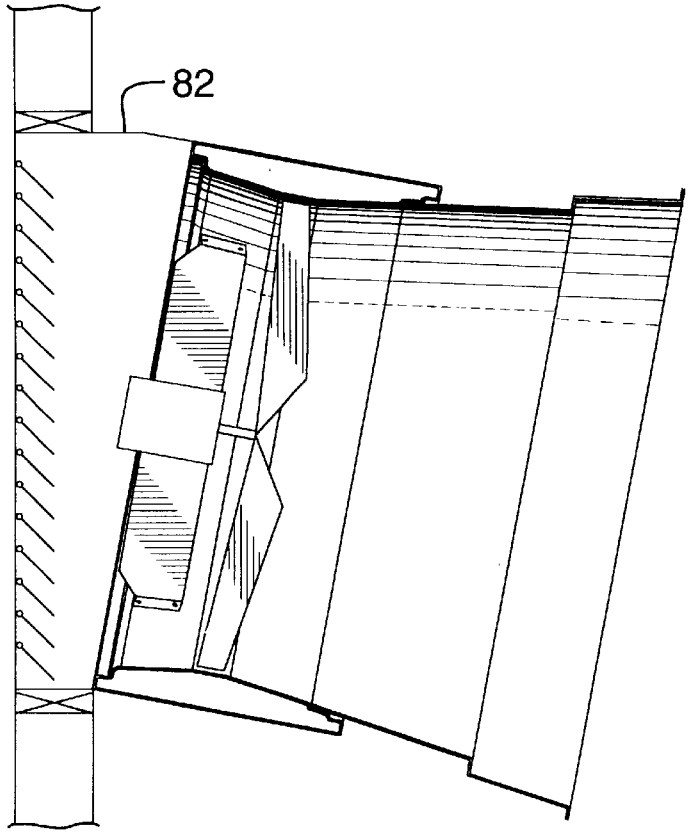

FIG. 7 is essentially an elevational view from the left in FIG. 1 (the rear of the fan) and shows in detail the support means 30 for the fan motor 28. FIG. 8 is a vertical sectional view on line 8—8 of FIG. 7.

In accordance with one aspect of the invention, the fan motor support means comprises at least three support arms which are of equal length and spaced equi-angularly about the rotational axis 24 of the fan blade assembly 26. In this particular embodiment, four support arms are provided, and are individually denoted 50. The arms extend radially outwardly with respect to axis 24 and are spaced mutually at right angles with respect to one another. Each arm extends between the motor 28 and the inlet section 42 of housing 20, as perhaps best shown in FIG. 8.

Each arm comprises a flat plate having a relatively thin and flat cross-sectional shape which is substantially uniform throughout the length of the arm so that the arm has a major dimension and a minor dimension. The minor dimension of the arm is denoted 52 in FIG. 7 and the major dimension of the arm is denoted 54 in FIG. 8. The arms are disposed so that the major dimension (54) of each arm is in line with the rotational axis 24 while the minor dimension (52) faces the air flow through the air flow opening 22. In this way, obstruction of the air flow by the arms 50 is minimized, as is turbulence caused by the motor support means. As noted previously, it is thought that the configuration and arrangement of the arms 50 may in fact have a "flow straightening" effect that would actually reduce turbulence.

By way of comparison, it has been calculated that, for a 36" diameter fan, the motor mounting arms of the invention represent less than 0.3% of the total surface area of the air flow opening at its inlet end. This compares with about 6.8% for a fan having a prior art motor mount. It is generally acknowledged that any air blockage is effectively doubled due to turbulence.

Each arm is coupled to the housing and the motor respectively at points spaced along the major dimension 54 of the arm so as to resist misalignment (tipping) of the motor with respect to the axis 24 of the air flow opening. In other words, by making a relatively "wide" arm and attaching the arm to the housing and the motor at points spaced along this wide dimension, the motor is rigidly held and any tendency to tip is resisted by the arm.

In the illustrated embodiment, each arm 50 has a lateral flange 56 at its outer end which is bolted to the inner surface of the housing 20 using the captive nuts incorporated into the moulding as discussed previously. Two of the mounting points represented by these nuts are indicated at 40 in FIG. 6. Similar pairs of moulded-in nuts are provided for the outer ends of the other three arms. At their inner ends, each of the arms 50 is bolted to an angle bracket 58 (see FIG. 7) that is welded to the motor casing so as to extend parallel to axis 24. Each of the brackets has a longitudinal extent corresponding to the major dimension 54 of arm 50 and the arm is bolted to the bracket at two spaced positions close to opposite edges of the arm.

It will be appreciated from FIG. 7 that, in addition to minimizing air flow obstruction and turbulence, and supporting motor 28 against twisting, the arms also provide what has been called a "self-centering" support for the motor. In other words, the motor will always be held points equidistantly spaced from the outer ends of the four arms 50, irrespective of any distortion of the housing 20 that might take place, for example, due to temperature changes or damage. Thus, any risk of the fan blades contacting the inner surface 32 of the housing is minimized. This compares with a conventional motor mount arrangement in which mounting bars extend generally diametrally of the air flow opening 22. In such a situation, housing can easily distort laterally along a diameter at right angles to the "diameter" occupied by the mounting arms. This can cause interference between the blade tips and the interior of the housing which is a common problem for the prior art. Re-alignment of the blade in the prior art is by trial and error and can be tedious and time consuming. In contrast, with the illustrated motor supporting arrangement, the motor is always supported equidistant from four equi-angularly spaced points on the inner surface of the housing.

The fan blade assembly 26 is essentially conventional and comprises a central hub 60 and a series (in this case three) of fan blades 62 that extend radially outwardly from the hub. As diagrammatically shown in FIG. 8, the hub 60 is mounted co-axially on an output shaft 28*a* of motor 28, providing the direct drive for the fan assembly discussed previously.

FIG. 9 illustrates various configurations that may be achieved using the basic box fan shown in the previous views. The views denoted (a) to (d) are all front views that show respectively different styles of fan. A protective screen will normally be bolted to the front face of the housing 20, using the attachment points 40 represented by the captive nuts. In FIG. 9, the fans are shown with the front screen removed. Where additional external components have been added to the basic housing, it is to be understood that they will have been attached using the captive nuts referred to previously, providing the attachment points denoted 40.

FIG. 9(*a*) shows a basic stationary circulating fan. In FIG. 9(*b*), chain clips or hinged hanging bars have been added as indicated at 62 to provide a hanging circulating fan. FIG. 9(*c*) shows a spray misting accessory kit 64 as having been added to the basic fan to provide for moisture in the air flow. In FIG. 9(*d*) wheels 66 and feet 68 have been added to the housing to make a portable circulating fan.

Different installation configurations are shown in FIGS. 9(*e*) to (*k*). All of these views are longitudinal cross-sectional views through the fan.

FIG. 9(*e*) shows the basic fan of FIGS. 1 to 8 installed in an opening in a wall 70. The next two views show the same fan but with louvre accessories bolted to the fan housing; in FIG. 9(*f*) an exhaust louvre accessory is shown at 72, and in FIG. 9(*g*) both an exhaust louvre accessory 72 and an inlet louvre accessory 74 are shown.

FIG. 9(*h*) is essentially the same as FIG. 9(*e*) but with a weather hood accessory 76 bolted to the outlet side of the fan housing.

FIG. 9(*i*) again shows the basic fan but this time with an optional performance enhancing cone 78 frictionally fitted to the outlet side of the fan housing. FIG. 9(*j*) shows the same installation as FIG. 9(*i*) but with an inlet louvre accessory 80 added at the opposite side of the housing. Finally, FIG. 9(*k*) shows a modified inlet louvre 82 which incorporates a slant fitting so that the fan exhaust is directed downwardly.

It is to be understood that the various configurations shown in FIG. 9 are possible arrangements only and are not be regarded as exhaustive. For example, two louvre accessories can be used to effectively insulate the fan during winter time. This avoids shutting down the fan, which is usually what happens when a cover is used, as in the prior art.

It should also be noted that the preceding description relates to particular preferred embodiments of the invention and that many modifications are possible, some of which have already been mentioned, while others will readily occur to a person skilled in the art. For example, though reference has been made to a plastic housing made in one piece by rotational moulding, a similar result could be obtained using separate components bonded together. Also, as noted previously, a belt drive fan could be used instead of the direct drive illustrated. While four motor mounting arms have been shown, as few as three, or more than four arms could be used. The size of the fan overall may of course vary. In particular, throat sizes and related fan components may vary to fit any existing axial fan blade size. The outside profile shape of the fan may be square as shown in the drawings, or rectangular, round or other appropriate shape.

We claim:

1. A fan comprising:

housing in the form of a one-piece moulded unit having an inner surface defining in air flow opening which extends about an axis, an outer perimeter surface, and front and rear surfaces extending between said inner surface and said outer surface;

a fan blade assembly supported in the housing for rotation about said axis; and, a motor carried by the housing and coupled to the fan blade assembly for rotating said assembly about said axis;

wherein the air flow opening has a generally cylindrical shape defined by an inlet section, an outlet section and a throat between the sections, the inlet section having a conically tapered shape which converges smoothly in a direction towards the throat, and the outlet section having a conically tapered shape which diverges smoothly in a direction away from the throat, the inlet and outlet sections merging smoothly with the throat so that turbulence in the air flow through the opening is minimized;

wherein said motor is coupled directly to the fan assembly coaxially therewith, and wherein the fan further includes means supporting the motor in the housing, comprising at least three support arms which are of substantially equal length and spaced substantially equi-angularly about said axis, extending generally radially between the motor and the housing, each arm having a relatively thin and flat cross-sectional shape which is substantially uniform throughout the length of the arm, so that the arm has a major dimension and a minor dimension, and each arm being disposed with its major dimension in line with said axis and its minor dimension facing in the direction of air flow through said opening, and coupled to each of the housing and motor respectively at points spaced along the major dimension of the arm, so as to resist misalignment of the motor with respect to the axis of the air flow opening.

2. A fan as claimed in claim 1, wherein each of said inlet section and said outlet section is conically tapered at a cone angle of approximately 8°.

3. A fan as claimed in claim 1, wherein said moulded unit incorporates a number of captive nuts which are moulded into the material and which form attachment points for components to be attached to the moulded unit.

4. A fan as claimed in claim 3, wherein each of the front and rear surfaces of said plastic moulded unit is shaped to define a protruding rim extending around the perimeter of said surface, and wherein said captive nuts are moulded into said rim at least in corner regions thereof for permitting attachment of external components, additional ones of said nuts being moulded into portions of the plastic moulding defining said air flow passageway for forming attachment points for said motor.

5. A fan as claimed in claim 1, wherein each of said support arms comprises a flat plate extending between the motor and the housing.

6. A fan as claimed in claim 5, wherein each said plate has a laterally directed flange at its outer end which is coupled to said housing within said air flow passageway at positions spaced along said flange adjacent respectively opposite ends thereof.

7. A fan as claimed in claim 6, wherein each said plate is bolted to the motor at positions spaced along the major dimension of the plate and adjacent respectively opposite ends thereof.

8. A fan comprising:

a housing in the form of a one-piece moulded unit having an inner surface defining an air flow opening which extends about an axis, an outer perimeter surface, and front and rear surfaces extending between said inner surface and said outer surface;

a fan blade assembly;

a motor coupled to the fan blade assembly for rotating the same about said axis, the motor being directly coupled to the fan blade assembly co-axially therewith; and, means supporting the motor in the housing so that the fan blade assembly rotates about said axis in use;

wherein said supporting means comprises at least three support arms which are of substantially equal length and spaced substantially equi-angularly about said axis, extending generally radially between the motor and the housing, each arm having a relatively thin and flat cross-sectional shape which is substantially uniform throughout the length of the arm, so that the arm has a major dimension and a minor dimension, and being disposed with its major dimension in line with said axis and its minor dimension facing the air flow through said opening, each said arm being coupled to each of the housing and motor respectively at points spaced along the major dimension of the arm, so as to resist misalignment of the motor with respect to the axis of the air flow opening.

9. A fan as claimed in claim 1, wherein said outlet section terminates at an outward annular step dimensioned to receive an extension cone, the height of the step being selected to correspond with the wall thickness of the cone so that the inner surface of the cone forms a smooth extension of the surface of the outlet section.

* * * * *